US011391023B2

(12) United States Patent
Ball

(10) Patent No.: US 11,391,023 B2
(45) Date of Patent: Jul. 19, 2022

(54) CONCRETE FORM FOR FREESTANDING BATH FILLER INSTALLATION AND METHOD OF USE

(71) Applicant: Kohler Co., Kohler, WI (US)

(72) Inventor: Matthew J. Ball, Sheboygan, WI (US)

(73) Assignee: KOHLER CO., Kohler, WI (US)

( * ) Notice: Subject to any disclaimer, the term of this patent is extended or adjusted under 35 U.S.C. 154(b) by 90 days.

(21) Appl. No.: 17/078,797

(22) Filed: Oct. 23, 2020

(65) Prior Publication Data

US 2021/0148097 A1 May 20, 2021

Related U.S. Application Data

(60) Provisional application No. 62/935,991, filed on Nov. 15, 2019.

(51) Int. Cl.

| | |
|---|---|
| ***E03C 1/04*** | (2006.01) |
| ***E03C 1/20*** | (2006.01) |
| ***E03F 5/04*** | (2006.01) |
| ***E03C 1/22*** | (2006.01) |
| *E03C 1/02* | (2006.01) |

(52) U.S. Cl.

CPC ..... *E03C 1/04* (2013.01); *E03C 1/20* (2013.01); *E03C 1/22* (2013.01); *E03F 5/0408* (2013.01); *E03C 2001/028* (2013.01)

(58) Field of Classification Search

CPC ..... E03C 1/04; E03C 1/20; E03C 1/22; E03C 2001/028; E03F 5/0408

USPC ..... 4/613

See application file for complete search history.

(56) References Cited

U.S. PATENT DOCUMENTS

| | | | | |
|---|---|---|---|---|
| 1,755,960 | A | 4/1930 | Kohler | |
| 4,345,998 | A * | 8/1982 | Graffis | E03F 5/0401 210/164 |
| 4,403,355 | A * | 9/1983 | Petty | E03C 1/12 4/679 |
| 4,804,160 | A | 2/1989 | Harbeke | |
| 4,823,527 | A | 4/1989 | Harbeke | |
| 5,257,487 | A | 11/1993 | Bantz et al. | |
| 6,061,983 | A | 5/2000 | McCleskey | |
| 6,755,966 | B1 * | 6/2004 | Reed | E03F 5/0408 4/679 |

(Continued)

FOREIGN PATENT DOCUMENTS

| | | |
|---|---|---|
| CN | 103669495 A | 3/2014 |
| CN | 105862998 A | 8/2016 |

OTHER PUBLICATIONS

First Chinese Office Action on CN Appl. Ser. No. 202011276014.8 dated Jan. 18, 2022 (23 pages).

*Primary Examiner* — Huyen D Le
(74) *Attorney, Agent, or Firm* — Foley & Lardner LLP

(57) ABSTRACT

A concrete form for installing a bath filler includes a base having an exposed top surface, a perimeter wall extending along each side of the base and oriented perpendicular to the base, and a rim extending from a top edge of the perimeter wall outwardly from the exposed top surface. The concrete form includes at least one notch disposed along the rim, such that the at least one notch is configured to align with a desired location of the bath filler. The concrete form includes a drill template corresponding with the notches. The drill template includes a plurality of markers configured to indicate drill-hole placement.

20 Claims, 8 Drawing Sheets

(56) References Cited

U.S. PATENT DOCUMENTS

| | | | | |
|---|---|---|---|---|
| 9,903,102 | B2 | 2/2018 | Zhou et al. | |
| 2009/0119831 | A1* | 5/2009 | Grave | E03C 1/20 4/613 |
| 2012/0018362 | A1* | 1/2012 | Swanston | B21D 28/24 210/232 |
| 2012/0036629 | A1 | 2/2012 | Cook | |
| 2012/0036632 | A1 | 2/2012 | Cook | |
| 2012/0036697 | A1 | 2/2012 | Cook | |
| 2012/0159758 | A1 | 6/2012 | Griffith | |
| 2014/0259371 | A1* | 9/2014 | Schaffer | A47K 3/405 4/613 |
| 2017/0002551 | A1 | 1/2017 | Zhou et al. | |

* cited by examiner

CONCRETE FORM FOR FREESTANDING BATH FILLER INSTALLATION AND METHOD OF USE

CROSS-REFERENCE TO RELATED APPLICATION

This application claims the benefit of and priority to U.S. Provisional Application No. 62/935,991, filed on Nov. 15, 2019, the entire disclosure of which is hereby incorporated by reference herein.

BACKGROUND

The present application relates generally to bath filler installation. More specifically, the present application relates to a concrete form for installing a freestanding bath filler.

Freestanding bath fillers may be mounted adjacent to a bathtub for filling the bathtub with water. They are typically mounted onto a floor and have a height sufficient to allow for positioning an outlet of the bath filler above a rim of the bathtub so that water may flow freely into the bathtub. Such freestanding bath fillers come in a wide variety of configurations and have varying feature sets. These bath fillers are connected to plumbing and are mounted in such a way as to stand next to the bathtub without being connected thereto. The present application is directed to improved systems and methods for installing such freestanding bath fillers.

In houses or dwellings without basements and crawl spaces, or in those that have poured concrete floors, freestanding bath fillers are typically installed into the concrete slab foundation. Installation of such a freestanding bath filler would typically require a complex process including excavating below grade, routing supply lines, and pouring concrete. Currently, installers are required to figure out how to install the bath fillers in concrete slabs with little guidance. Some freestanding bath fillers are secured to the floor, which creates a risk of damaging delicate tile. The concrete form disclosed in this application is designed to eliminate the guesswork of placing the bath filler mounting blocks, thus significantly simplifying the installation process.

The following description focuses primarily on concrete flooring installation, but it should be appreciated that the disclosed form can be formed on other floor surfaces in a bathing or shower environment (e.g., bathtubs, etc.) to provide guidance and aligning in various installation processes. Thus, it would be advantageous to provide an improved form that overcomes the foregoing challenges and provides a number of advantages, including having an aesthetically pleasing design and a structure that may be installed in a manner that advantageously helps to prevent cuts and scraped hands during the installation process. These and other advantageous features will become apparent to those reviewing the present disclosure.

SUMMARY

At least one embodiment relates to a concrete form for installing a bath filler. The concrete form includes a base having an exposed top surface, a perimeter wall extending along each side of the base and oriented perpendicular to the base, and a rim extending from a top edge of the perimeter wall outwardly from the exposed top surface. The concrete form includes at least one notch disposed along the rim, such that the at least one notch is configured to align with a desired location of the bath filler. The concrete form includes a drill template corresponding with the notches. The drill template includes a plurality of markers configured to indicate drill-hole placement.

Another embodiment relates to a freestanding bath filler system. The freestanding bath filler system includes a concrete form including a base having an exposed top surface, a perimeter wall extending along each side of the base and oriented perpendicular to the base, and a rim extending from a top edge of the perimeter wall outwardly from the exposed top surface. The concrete form includes at least one notch disposed along the rim, such that the at least one notch is configured to align with a desired location of the freestanding bath filler. The concrete form includes a drill template corresponding with the notches. The drill template includes a plurality of markers configured to indicate drill-hole placement. The freestanding bath filler system further includes a concrete pad formed underneath the concrete form, a mounting block configured to couple to the concrete pad through an opening corresponding to the drill template, and a flooring underlayment disposed on the rim of the concrete form. The mounting block is configured to support the freestanding bath filler and to receive a fluid supply line.

Another embodiment relates to a method of using a freestanding bath filler concrete form. The method includes placing a concrete form into a hole, routing at least one fluid supply line through an inlet of the concrete form, and aligning the concrete form, via at least one notch, with an orientation template configured for placement of at least the freestanding bath filler. The method further includes pouring concrete into the hole around the concrete form, drilling mounting holes for the freestanding bath filler mounting block through the concrete form using a drill template disposed on a base of the concrete form, removing the drill template from the concrete form, and coupling the mounting block to the concrete.

This summary is illustrative only and is not intended to be in any way limiting.

BRIEF DESCRIPTION OF THE DRAWINGS

The disclosure will become more fully understood from the following detailed description, taken in conjunction with the accompanying figures, wherein like reference numerals refer to like elements, in which:

FIG. 4 is a perspective view of an installation step of the concrete form shown in

FIG. 1.

DETAILED DESCRIPTION

Before turning to the figures, which illustrate certain exemplary embodiments in detail, it should be understood that the present disclosure is not limited to the details or methodology set forth in the description or illustrated in the figures. It should also be understood that the terminology used herein is for the purpose of description only and should not be regarded as limiting.

Referring generally to the figures, disclosed herein is a freestanding bath filler mounting block concrete form. The concrete form includes an upper flange to align with the existing poured concrete floor and a rim to support tile-backer or flooring underlayment to span the opening and reduce the likelihood of tile breakage or flooring damage. The form may contain pre-formed drill points along the outer perimeters so holes can be placed in numerous locations for routing the supply lines.

Figure 1:
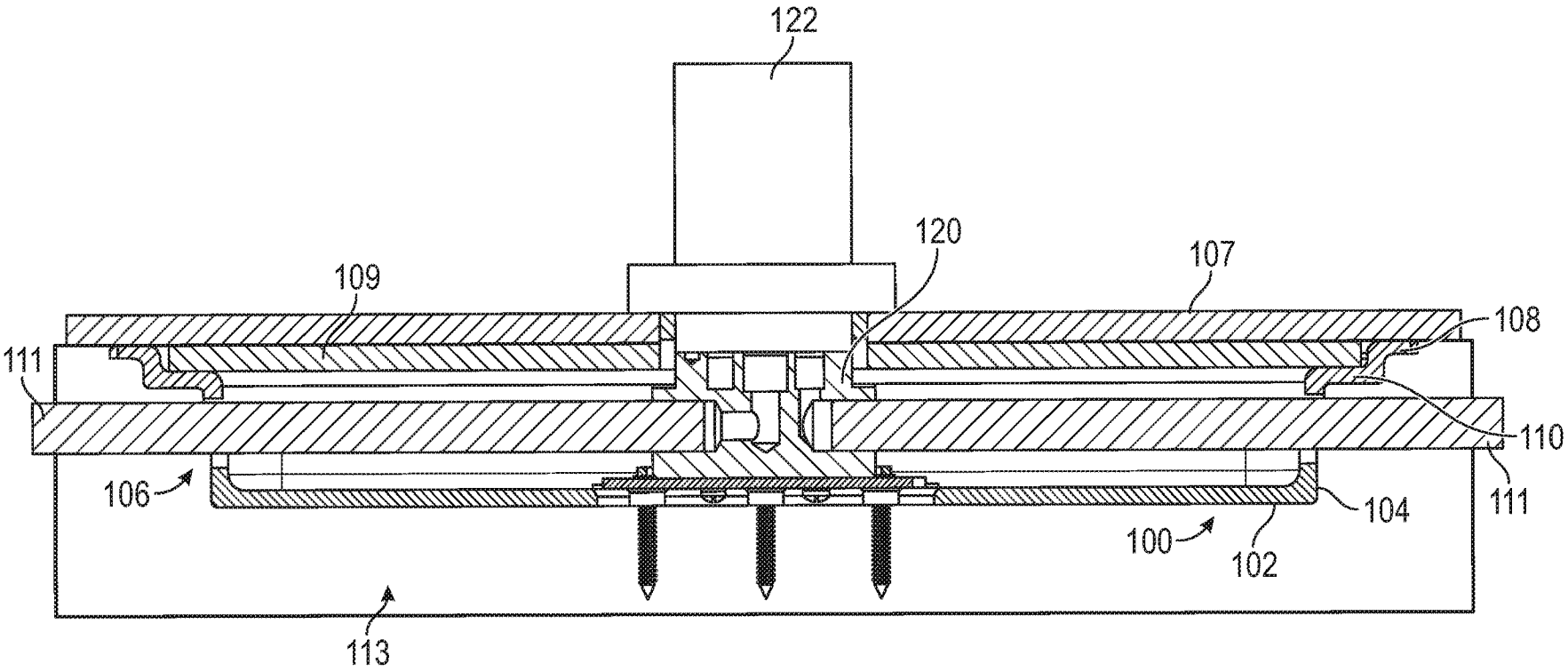
FIG. 1 is a schematic view of a concrete form, in accordance with an exemplary embodiment of the present application.

Referring to FIG. 1, a concrete form 100 is shown according to an exemplary embodiment. The concrete form 100 may be thermoformed plastic or injection molded plastic, for instance. The concrete form 100 includes a base 102, which is generally rectangular, and a perimeter wall 104. The base 102 may be rectangular or it may be any shape (e.g., triangular, circular, oblong, etc.) suitable for the installation space. The perimeter wall 104 extends perpendicular to the base 102 from the exposed surface of the base 102, and extends along each side of the base 102. Projecting perpendicular to the perimeter wall 104 and parallel to the base 102 may be a flange 108 and a rim 110. The flange 108 and the rim 110 extend out from the top edge of the perimeter wall 104 and beyond the perimeter of the base 102 and are connected to each other in a step-like manner. The flange 108 and the rim 110 (e.g., a lip) are designed to align the concrete form 100 with the existing poured concrete and to support tile 107 or flooring underlayment 109, respectively. In various other embodiments, only the rim 110 is provided.

Referring still to FIG. 1, drill points 106 (also shown in FIG. 2) may be disposed on two sides of the perimeter wall 104. There may be a plurality of drill points 106 along the sides to selectively drill holes through the concrete form 100 at the necessarily point to properly place and correspond with supply lines 111 (e.g., water supply lines). Drill points may be placed, for instance, every three inches along the desired sides of entry to ensure options for a variety of supply line placements. The drill points 106 position the inlets at the correct distance from the future poured concrete pad 113 by providing a clear route from the supply lines through the concrete form 100 prior to pouring the concrete.

Figure 2:
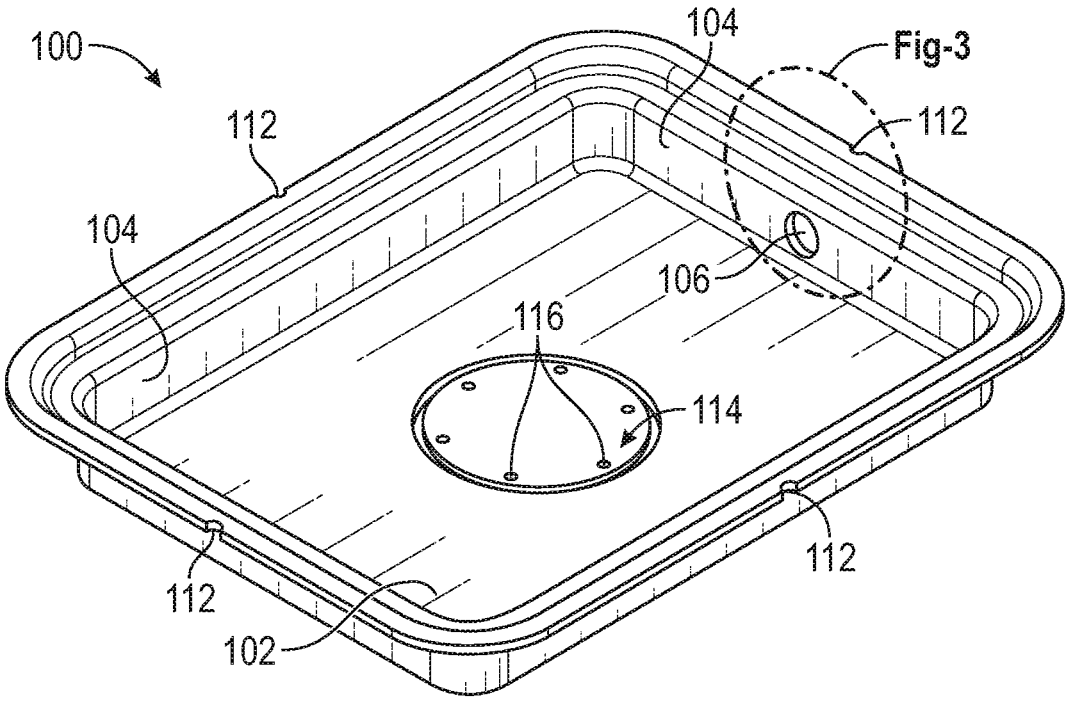
FIG. 2 is a perspective view of the concrete form shown in FIG. 1.
Figure 3:
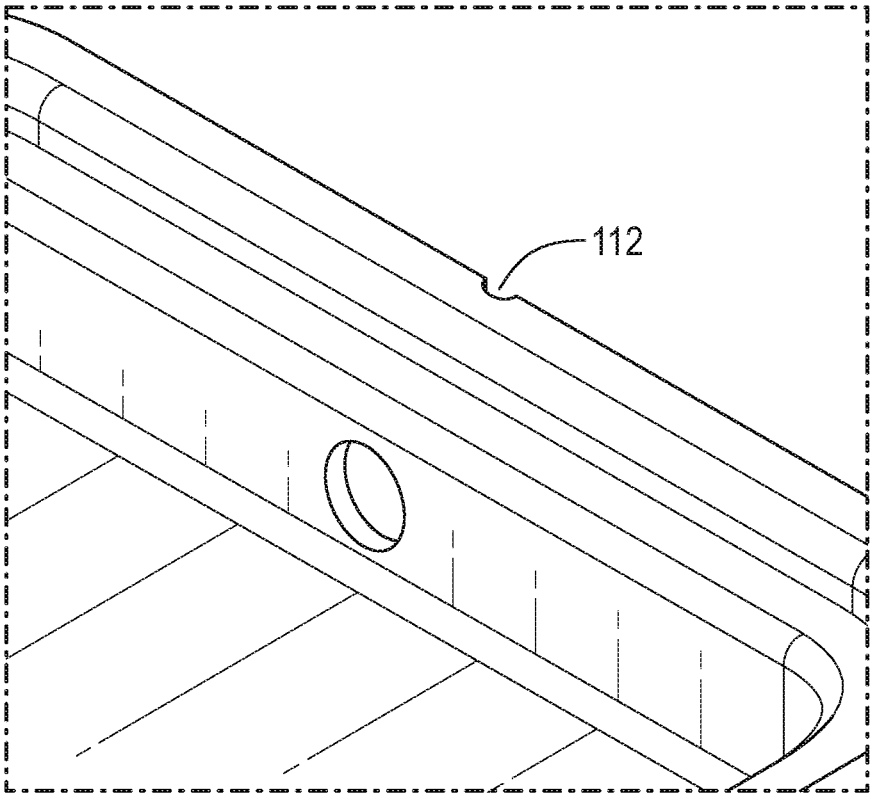
FIG. 3 is a perspective view of a notch of the concrete form shown in FIG. 1.
Figure 4:
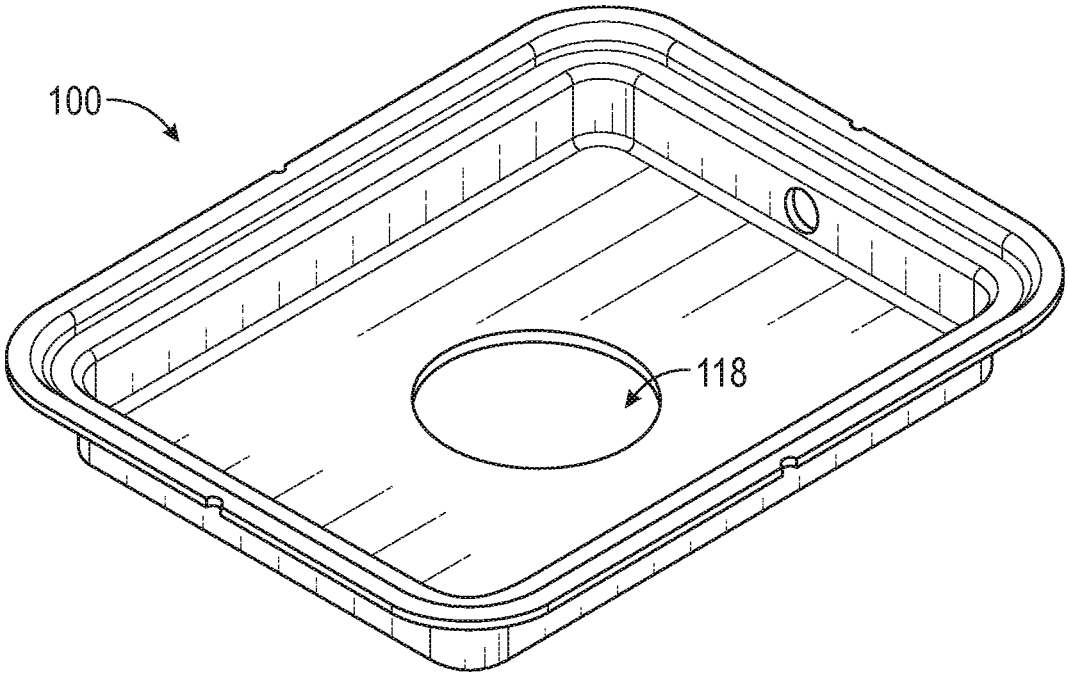

As shown in FIGS. 2-4, notches 112 may be made on the flange 108 or the rim 110 to help further align the concrete form 100 with the bath placement. As shown in FIG. 3, the notches 112 may be defined by a cut out or by a ridge in the edge of the flange. However, the notches 112 may be any alternative feature configured to align the concrete form 100 with the future bath placement. For instance, as shown in FIGS. 10-13, the notches 112 could be molded or formed-in features such as raised bumps/protrusions, channels, or grooves. The notches 112 may also be formed by laser/engraving, cutting/milling grooves, marking with ink by pad printing, adding a label, etc.

Figure 8:
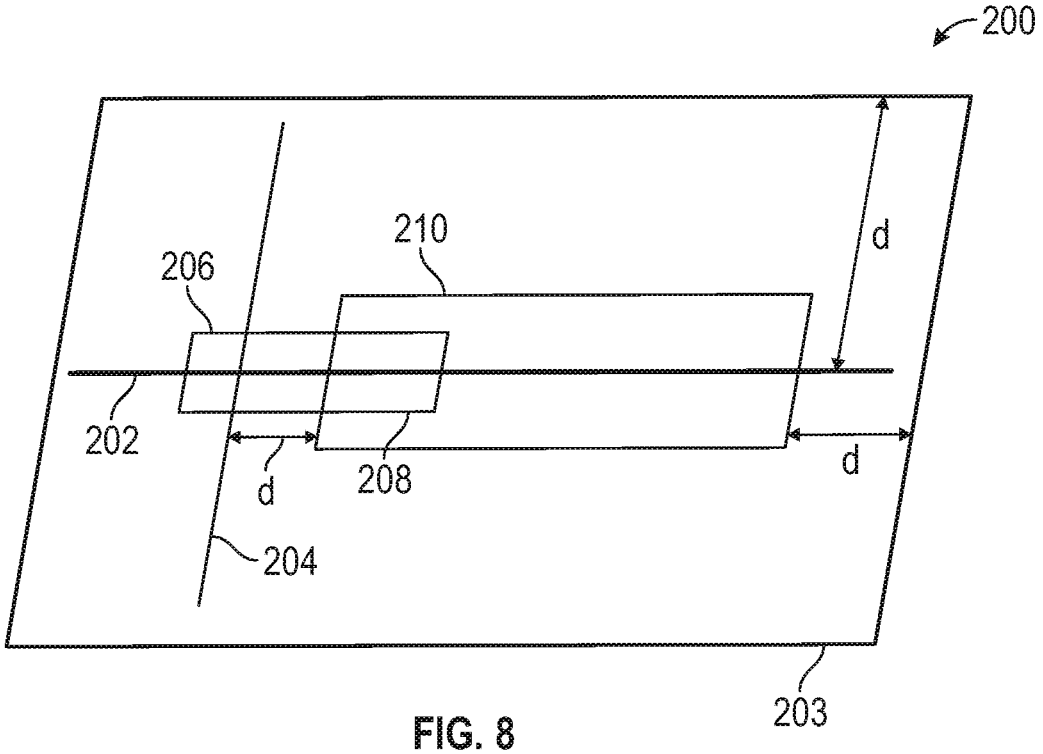
FIG. 8 is a schematic view of an orientation template, in accordance with an exemplary embodiment of the present application.

The notches 112 may be used to indicate the center, for instance, of the concrete form 100 in order to allow accurate measurement and alignment with the pre-measured placements/scoring on the floor for the bath, for instance, prior to installation. However, the notches may be offset from the center as well if needed to better align with an off-center placement of the bath filler. The notches 112 allow the installer to visually align the orientation of the concrete form with the intended installation location. For example, an orientation template 200 is illustrated in FIG. 8. The orientation template 200 is configured according to specified dimensions d which are determined based on the particular bath and working space for each individual installation. A first chalk line 202 may be present on the concrete slab 203 to align the centerline of the filler, bath drain, and the length of the bath. A second chalk line 204 may be present on concrete slab 203, running perpendicular to the first chalk line 202 and parallel to the width of the bath, thus indicating where the filler is intended to be installed (i.e., at the crossing point of the first and second chalk lines 202, 204). Further, a bath filler pocket 206 for placement of the bath filler, a drain pocket 208 for placement of the pipes, and a bath footprint 210 may be present to visualize the overall placement of the bath system.

Figure 9:
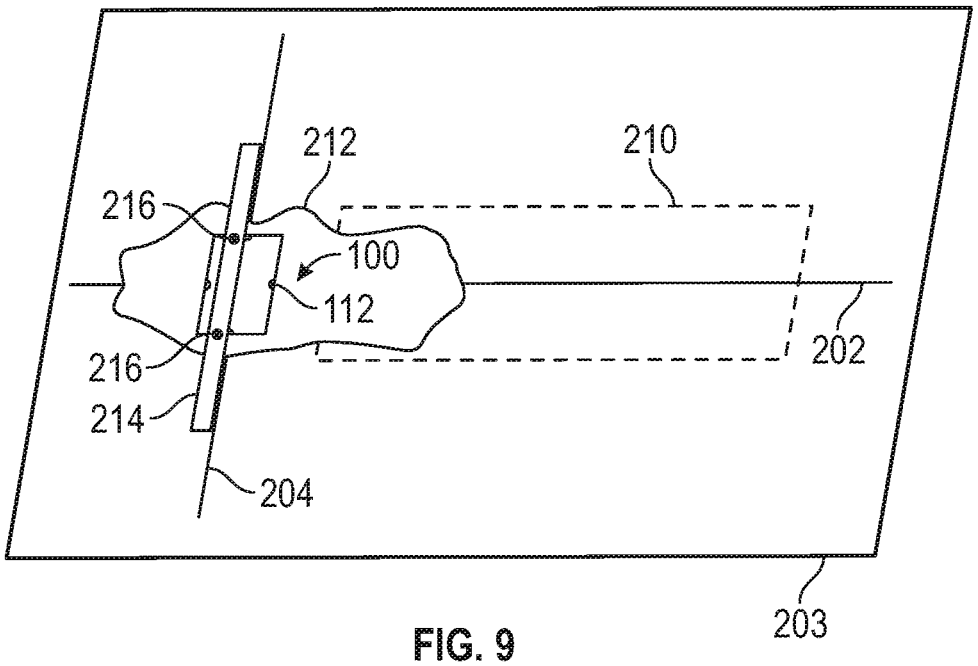
FIG. 9 is a schematic view of a concrete form installed in a concrete slab, in accordance with an exemplary embodiment of the present application.
Figure 10:
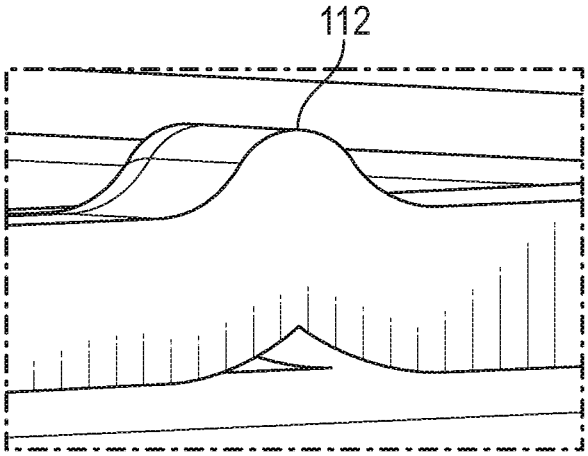
FIGS. 10-13 are perspective views of a notch of the concrete form, in accordance with another exemplary embodiment of the present application.
Figure 11:
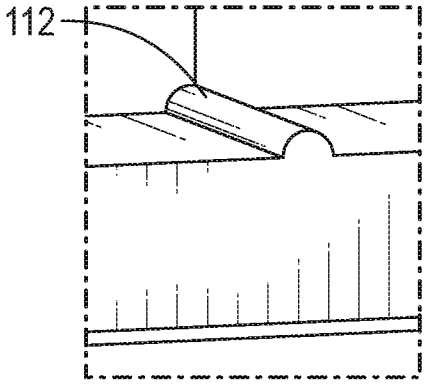
Figure 12:
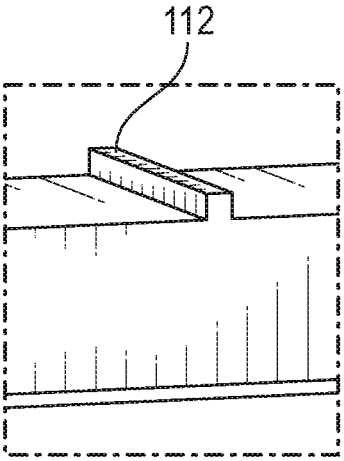
Figure 13:
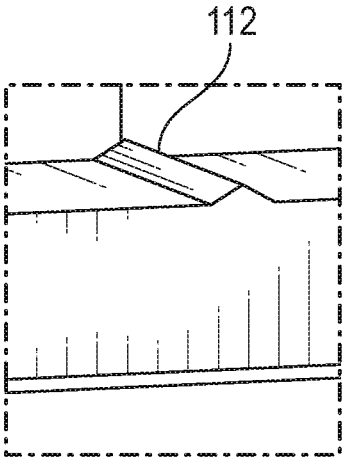

As shown in FIG. 9, when the concrete is removed at the bath filler pocket 206 and the drain pocket 208, a hole 212 is created. The notches 112 provide references to the true center of the concrete form 100 and are to be aligned with the first and second chalk lines 202, 204, thus positioning the concrete form 100 where the bath filler is intended to be installed (i.e., where the cross-hair marking of the first and second chalk lines 202, 204 would be located had the hole 212 not been created). This ensures the markers 116 (FIG. 2) are orientated correctly relative to the bath so the bath filler is aimed properly to the bath. Further, a board 214 may be placed over the top flange 108 and secured to the concrete form 100 with screws 216 to hold the concrete form 100 level with the plane of the remaining concrete slab 203. The board 214 may also be secured to the concrete slab 203 to hold it in place while concrete is poured. The board 214 may be secured to the concrete form 100 adjacent the notches 112 so it can be aligned adjacent the second chalk line 204 on the concrete slab 203 as well.

The base 102 includes a drill template 114. The drill template 114 may be circular, or a similar shape to a mounting block that will be used for the freestanding bath filler. The drill template 114 may have a plurality of markers 116 along its circumference. For example, when the concrete is cured, holes for the mounting block fasteners can be drilled directly through the concrete form 100, as indicated by markers 116 on the drill template 114, thus ensuring proper placement of the mounting block. The drill template 114 may be centered along the base 102 or may be offset from the center in any direction. The drill template 114 is perforated and can be removed (as shown in FIG. 4). Removing the drill template 114 to expose an opening 118 ensures the most stable connection between the mounting block and the concrete.

Figure 14:
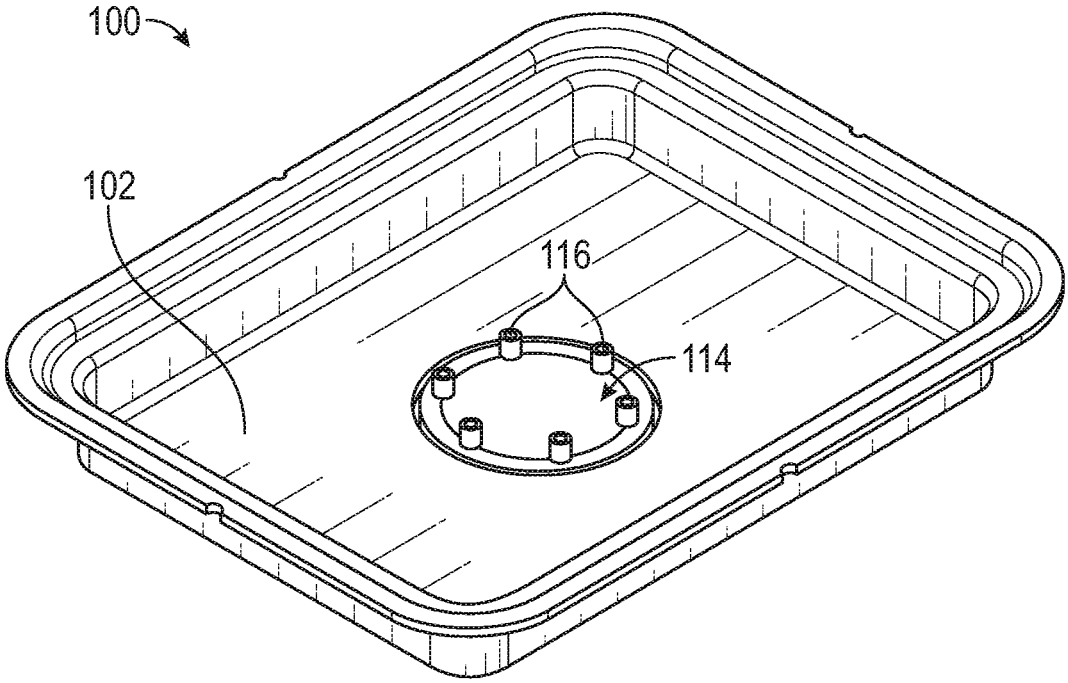
FIG. 14 is a perspective view of markers of the concrete form, in accordance with another exemplary embodiment of the present application.

Alternatively, if the form is injection molded rather than thermoformed, then it would be advantageous to mold in long bosses into the drill template 114 to form integral "drill bushings" (e.g., the markers 116), as shown in FIG. 14. The markers 116 as bosses will help to ensure the holes for the mounting block are perpendicular to the surface being drilled. The markers 116 may also aid in the removal of the drill template 114 from the concrete form 100. Not shown but optional are any connecting ribs or structures meant to keep these bosses perpendicular to the surface. The integral drill bushing, or the markers 116, may be about 7/16" diameter by about ½" tall, or any other height and diameter. The integral drill bushing or markers 116 may also include an optional chamfered or rounded entrance and/or exit.

Figure 5:
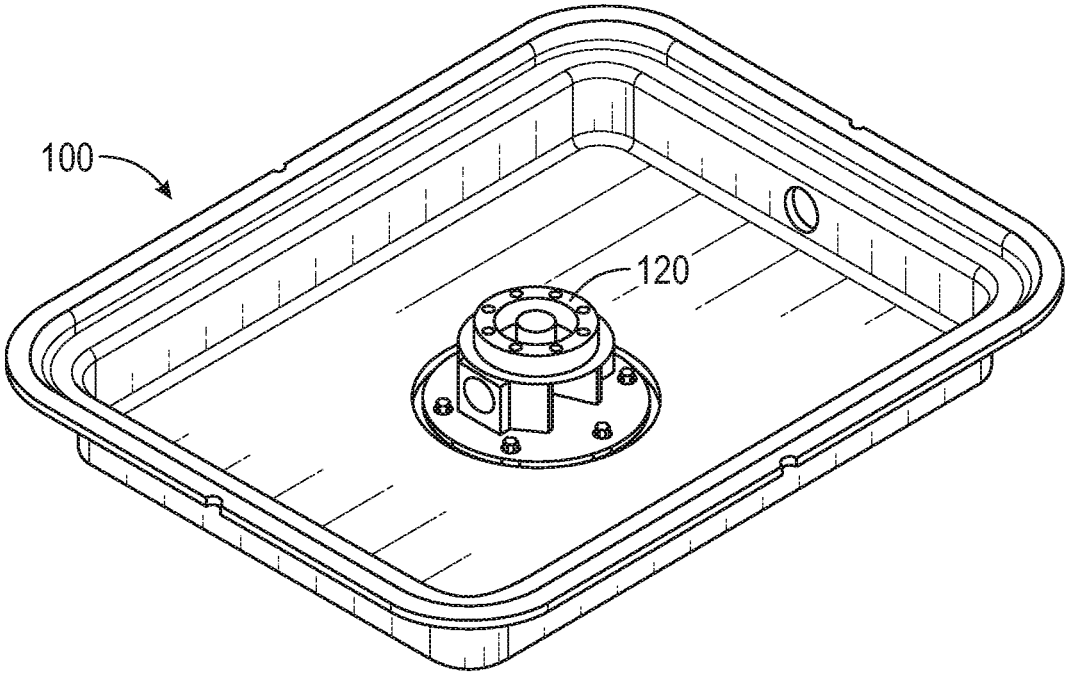
FIG. 5 is a perspective view of an installation step of the concrete form shown in FIG. 1.
Figure 6:
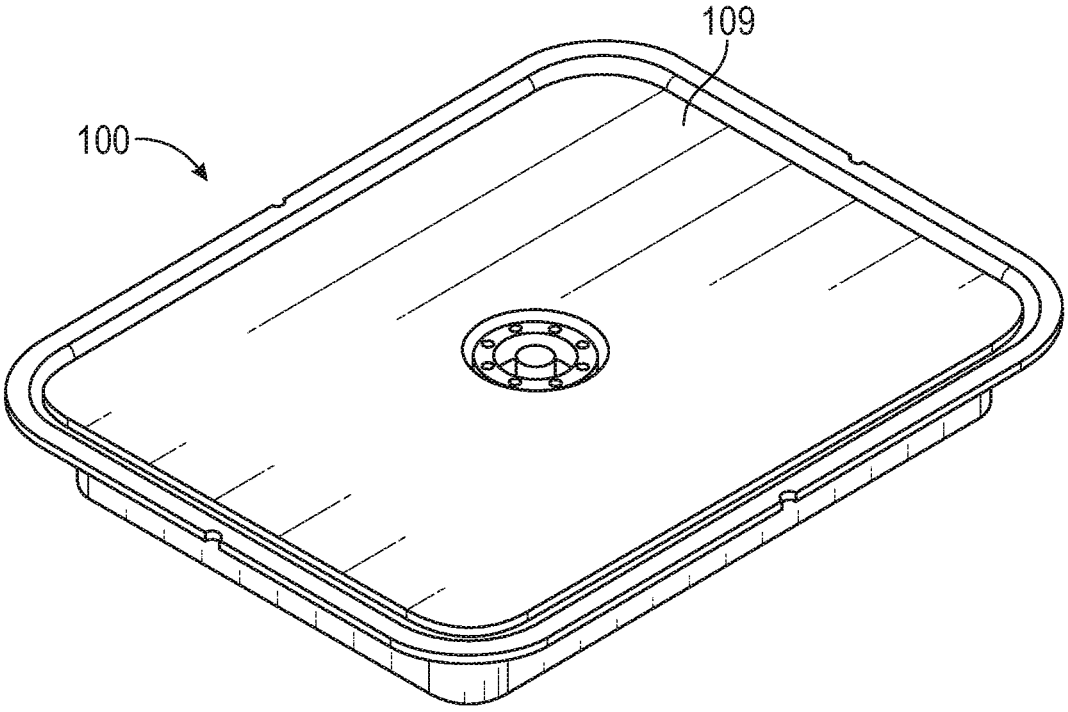
FIG. 6 is a perspective view of an installation step of the concrete form shown in FIG. 1.

Referring to FIGS. 5-6, a mounting block 120 can then be placed within the concrete form 100 and secured to the concrete pad 113, such as through the opening 118 in the base 102 of the concrete form 100. The mounting block 120 supports a free standing bath filler and receives the hot and cold water supplies, which route through the holes corresponding to the drill points 106 and into openings in the mounting block 120 to the bath filler. The tile-backer or flooring underlayment 109 is then placed on the rim 110 of the concrete form 100 and installation of the concrete form 100 is complete. A freestanding bath filler 122 (as shown in FIG. 1) may then be connected to the mounting block 120. The freestanding bath filler 122 will extend above the tile 107 and be further configured to route water from the supply lines 111 to fill a bathtub, for instance.

Figure 7:
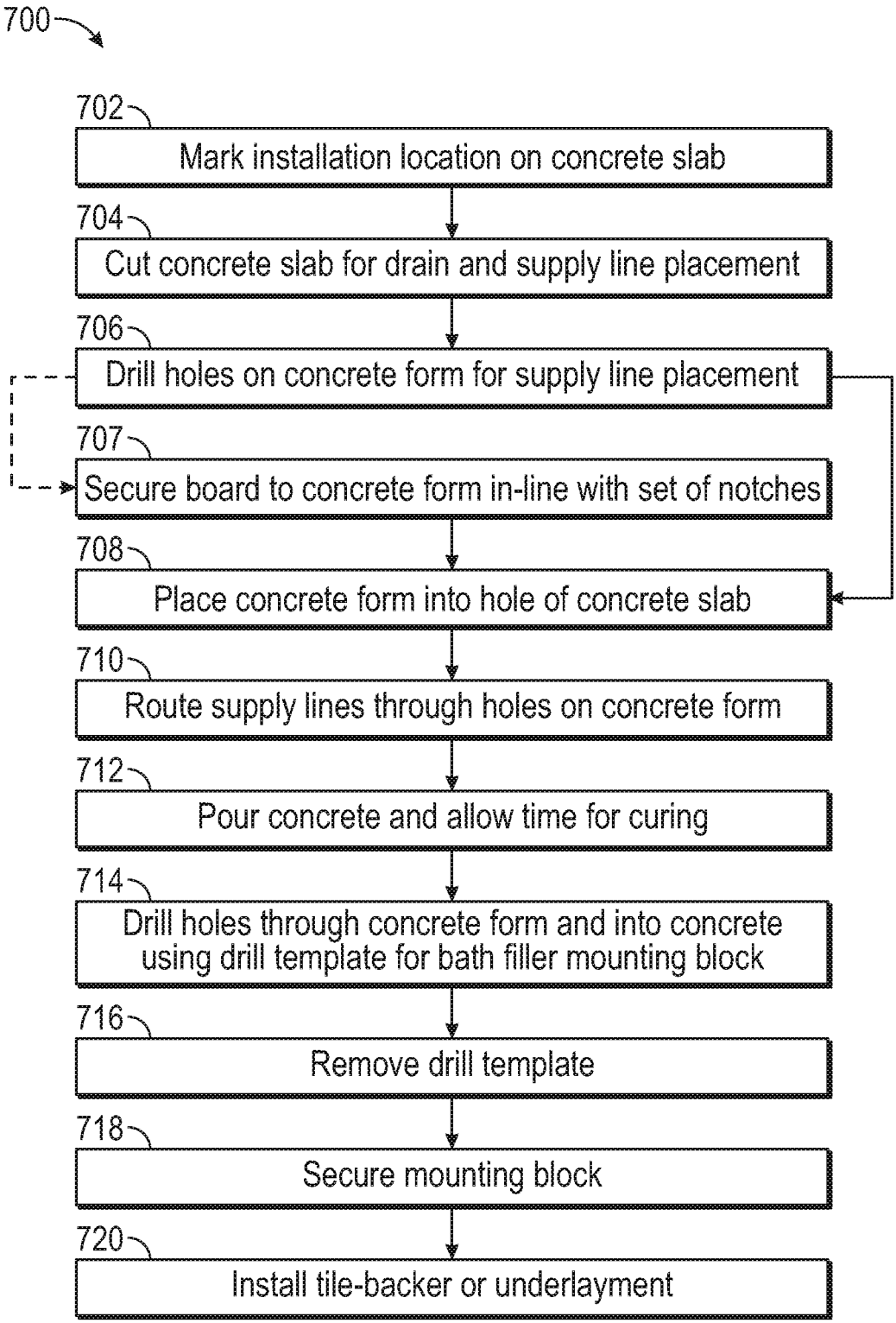
FIG. 7 is a flow chart illustrating a method for using a concrete form for freestanding bath filler installation, in accordance with an exemplary embodiment of the present application.

Referring to FIG. 7, a method 700 for using a freestanding bath filler concrete form is shown according to an exemplary embodiment. At step 702, the installation location is marked on the concrete slab. Chalk lines can be snapped to indicate the X, Y locations of the bath filler's center. At step 704, the concrete slab is cut and removed for plumbing placement, such as the supply lines. Cutting the concrete may be done using a saw, hammer drill, sledgehammer, jack hammer, chisel and hammer, etc. For a new construction site, if the working space is not poured with concrete (e.g., a site-built 2-by lumber or a similar form which "reserves" the space), significant labor can be eliminated. The supply lines are placed below grade, projecting the floor surface where desired. Plumbing inspection may occur here at this point. At step 706, the installer drills holes in the side of the concrete form where the supply lines are to be placed. Optionally, at step 707, a board is secured to the form in-line with one set of notches on the concrete form. At step 708 and 710, the concrete form is placed into the hole and supply lines are routed through the inlet holes previously drilled. Specifically, at step 708, the concrete form is aligned with the orientation template for bath placement via the notches in the center of the four sides. If the board was used at step 707, the board is also placed and aligned with the notches. Voids may be filled with plumber's putty or a suitable construction material. At step 712, the new concrete is poured and cured. If the board was used to hold the concrete form in place, it is now removed. At step 714, the installer drills mounting holes for the bath filler mounting block through the form using the drill template on the base. At step 716, the installer scores the concrete form with a utility knife and removes the drill template from the concrete form. At step 718, the installer secures the mounting block to the concrete pad and makes water supply connections. At step 720, the installer places fabricated underlayment/tile-backer onto the rim of the concrete form. Thus, the flooring and bath filler mounting block are installed.

The present disclosure describes a concrete form that can, advantageously, provide guidance and alignment for free-standing bath fillers. Benefits of the concrete form and methods described herein include, for example, a template to better position the bath filler mount and water lines prior to thus creating a "knuckle saver" solution, allowing installers to increase efficiently, accuracy and ease during the installation process.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

The construction and arrangement of the elements as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements, the position of elements may be reversed or otherwise varied, and the nature or number of discrete elements or positions may be altered or varied.

Additionally, the word "exemplary" is used to mean serving as an example, instance, or illustration. Any embodiment or design described herein as "exemplary" is not necessarily to be construed as preferred or advantageous over other embodiments or designs (and such term is not intended to connote that such embodiments are necessarily extraordinary or superlative examples). Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the appended claims.

Other substitutions, modifications, changes and omissions may also be made in the design, operating conditions and arrangement of the various exemplary embodiments without departing from the scope of the present invention. For example, any element disclosed in one embodiment may be incorporated or utilized with any other embodiment disclosed herein. Also, for example, the order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the scope of the appended claims.

While this specification contains many specific implementation details, these should not be construed as limitations on the scope of any inventions or of what may be claimed, but rather as descriptions of features specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. In some cases, the actions recited herein can be performed in a different order and still achieve desirable results. In certain circumstances, multitasking and parallel processing may be advantageous. Moreover, the separation of various components in the embodiments described above should not be understood as requiring such separation in all embodiments.

What is claimed is:

1. A concrete form for installing a bath filler, the concrete form comprising:
- a base having an exposed top surface;
- a perimeter wall extending along each side of the base and oriented perpendicular to the base;
- a rim extending from a top edge of the perimeter wall outwardly from the exposed top surface;
- at least one notch disposed along the rim, the at least one notch configured to align with a desired location of the bath filler; and
- a drill template corresponding with the notches, the drill template comprising a plurality of markers configured to indicate drill-hole placement.

2. The concrete form of claim 1, wherein the at least one notch is one of a cut out, a ridge, raised bumps, a protrusion, a channel, or a groove.

3. The concrete form of claim 1, wherein the at least one notch is located at a center of the perimeter wall.

4. The concrete form of claim 1, further comprising a flange extending from a top edge of the perimeter wall outwardly from the rim, wherein the rim and the flange are configured in a step-like manner.

5. The concrete form of claim 4, wherein the at least one notch is disposed on the flange.

6. The concrete form of claim 1, further comprising at least one drill point disposed on at least one side of the perimeter wall, wherein the at least one drill point is configured to receive at least one fluid supply line.

7. The concrete form of claim 1, wherein the drill template is circular, and wherein the plurality of markers are disposed along a circumference of the drill template.

8. The concrete form of claim 1, wherein the drill template is centered along the base.

9. The concrete form of claim 1, wherein the drill template is perforated and configured to be removed to expose an opening for a mounting block to be coupled to a concrete pad through the concrete form.

10. The concrete form of claim 1, where the markers are bosses on the drill template to form integral drill bushings.

11. A freestanding bath filler system comprising:
- a concrete form comprising:
  - a base having an exposed top surface;
  - a perimeter wall extending along each side of the base and oriented perpendicular to the base;
  - a rim extending from a top edge of the perimeter wall outwardly from the exposed top surface;
  - at least one notch disposed along the rim, the at least one notch configured to align with a desired location of the freestanding bath filler; and
  - a drill template corresponding with the notches, the drill template comprising a plurality of markers configured to indicate drill-hole placement;
- a concrete pad formed underneath the concrete form;
- a mounting block configured to couple to the concrete pad through an opening corresponding to the drill template, the mounting block configured to support the freestanding bath filler and to receive a fluid supply line; and
- a flooring underlayment disposed on the rim of the concrete form.

12. The freestanding bath filler system of claim 11, further comprising an orientation template configured to specify dimensions of an installation site.

13. The freestanding bath filler system of claim 12, wherein the orientation template comprises:
- a first line configured to align a centerline of the freestanding bath filler, a bath drain, and a length of a bathtub;
- a second line oriented perpendicularly to the first line and parallel to a width of the bathtub, wherein an intersection of the first and second lines indicates an installation position of the freestanding bath filler;
- a bath filler pocket configured to align placement of the freestanding bath filler;
- a drain pocket configured to align placement of the fluid supply line; and
- a bath footprint configured to align placement of the freestanding bath filler system.

14. The freestanding bath filler system of claim 11, wherein the fluid supply line is routed through a corresponding drill point and into openings in the mounting block to the freestanding bath filler.

15. A method of using a freestanding bath filler concrete form, the method comprising:
- placing a concrete form into a hole;
- routing at least one fluid supply line through an inlet of the concrete form;
- aligning the concrete form, via at least one notch, with an orientation template configured for placement of at least the freestanding bath filler;
- pouring concrete into the hole around the concrete form;
- drilling mounting holes for the freestanding bath filler mounting block through the concrete form using a drill template disposed on a base of the concrete form;
- removing the drill template from the concrete form; and
- coupling the mounting block to the concrete.

16. The method of claim 15, further comprising marking the orientation template with a first line and a second line, wherein the intersection of the first and second lines indicates a location of the freestanding bath filler.

17. The method of claim 15, further comprising cutting the concrete form to form the inlet for placement of the at least one fluid supply line.

18. The method of claim 15, further comprising securing a board to the concrete form in-line with the at least one notch.

19. The method of claim 15, further comprising coupling the at least one fluid supply line routed through the inlet hole to the freestanding bath filler mounting block.

20. The method of claim 15, further comprising placing a flooring underlayment onto a rim of the concrete form.

* * * * *